US008104333B2

(12) United States Patent
Takakura

(10) Patent No.: US 8,104,333 B2
(45) Date of Patent: Jan. 31, 2012

(54) LEAK DIAGNOSTIC METHOD FOR AN EVAPORATIVE EMISSION CONTROL SYSTEM

(75) Inventor: Shinsuke Takakura, Kawasaki (JP)

(73) Assignee: Nissan Motor Co., Ltd., Yokohama (JP)

( * ) Notice: Subject to any disclaimer, the term of this patent is extended or adjusted under 35 U.S.C. 154(b) by 490 days.

(21) Appl. No.: 12/417,474

(22) Filed: Apr. 2, 2009

(65) Prior Publication Data

US 2009/0277251 A1 Nov. 12, 2009

(30) Foreign Application Priority Data

May 9, 2008 (JP) ..... 2008-123150
Jan. 27, 2009 (JP) ..... 2009-015090

(51) Int. Cl.
*F02M 25/08* (2006.01)

(52) U.S. Cl. ..... 73/114.39

(58) Field of Classification Search ..... 73/114.38, 73/114.39

See application file for complete search history.

(56) References Cited

U.S. PATENT DOCUMENTS 5,448,980 A 9/1995 Kawamura et al.
6,164,123 A 12/2000 Corkill
6,182,642 B1 2/2001 Ohkuma
6,807,851 B2 * 10/2004 Wakahara et al. ..... 73/114.39
7,140,241 B2 * 11/2006 Wakahara ..... 73/114.39
7,448,257 B2 11/2008 Kimura
2003/0019286 A1 * 1/2003 Wakahara et al. ..... 73/118.1
2003/0056573 A1 3/2003 Miwa et al.
2005/0039525 A1 * 2/2005 Wakahara et al. ..... 73/118.1
2007/0113633 A1 * 5/2007 Kimura ..... 73/118.1
2007/0113634 A1 * 5/2007 Kimura ..... 73/118.1
2007/0214876 A1 9/2007 Miyahara

FOREIGN PATENT DOCUMENTS

CN 1971021 A 5/2007
DE 1002157 A1 1/2001
EP 1457661 A2 9/2004
JP 2003-083176 A 3/2003

OTHER PUBLICATIONS

The extended European Search Report of corresponding European Application No. 09159598.3-2311, dated Feb. 17, 2011.
The Chinese Office Action of corresponding Chinese Application No. 200910140705.2, dated Oct. 8, 2010.

* cited by examiner

*Primary Examiner* — Hezron E Williams
*Assistant Examiner* — Nathaniel Kolb
(74) *Attorney, Agent, or Firm* — Global IP Counselors, LLP

(57) ABSTRACT

A leak diagnostic apparatus is provided for an evaporative emission control system that purges fuel vapor from an inside of a fuel tank to an intake passage of an internal combustion engine. The leak diagnostic apparatus is basically provided with a pressure detecting device and a leak determining device. The pressure detecting device is configured and arranged to detect a pressure inside the evaporative emission control system, which includes the fuel tank. The leak determining device sets a leak determination threshold value in accordance with a deformation amount of the fuel tank, and determines if a leak exists by comparing the pressure inside the evaporative emission control system while the evaporative emission control system is sealed to the leak determination threshold value.

5 Claims, 6 Drawing Sheets

LEAK DIAGNOSTIC METHOD FOR AN EVAPORATIVE EMISSION CONTROL SYSTEM

CROSS-REFERENCE TO RELATED APPLICATIONS

This application claims priority to Japanese Patent Application Nos. 2008-123150, filed on May 9, 2008, and 2009-015090, filed on Jan. 27, 2009. The entire disclosures of Japanese Patent Application Nos. 2008-123150 and 2009-015090 are hereby incorporated herein by reference.

BACKGROUND OF THE INVENTION

1. Field of the Invention

The present invention generally relates to a leak diagnostic apparatus for an evaporative emission control system that purges fuel vapor (evaporated fuel) from a fuel tank to an intake passage of an engine.

2. Background Information

In order to prevent fuel vapor from being discharged to the atmosphere, a known evaporative emission control system directs fuel vapor from inside a fuel tank through a fuel vapor vent passage to a canister where the fuel is adsorbed. The fuel evaporative emission control system then purges the adsorbed fuel vapor to an intake passage of an engine. In this kind of evaporative emission control system, the amount of fuel vapor that is purged to the intake passage is adjusted by controlling the opening degree of a purge valve provided in a passage communicating between the canister and the intake passage.

A known method of diagnosing such an evaporative emission control system for leakage is to close the purge valve such that the space from the fuel tank to the purge valve is sealed and determine if a leak exists based on a pressure change occurring inside the sealed space. However, there are times when the fuel tank changes shape due to a difference between the internal and external pressures of the fuel tank, thus causing the volume of the fuel tank to change. The change in volume can affect the pressure in the sealed space and cause an incorrect diagnosis to occur. Therefore, the technology disclosed in Japanese Laid-Open Patent Publication No. 2003-83176 is contrived to detect a pressure inside the fuel tank during a leak diagnosis and stop the leak diagnosis if a pressure change indicative of a large change in the shape of the fuel tank occurs.

SUMMARY OF THE INVENTION

If the amount by which the fuel tank changes shape (deforms) is large and the change in shape (deformation) is sudden, then it will be difficult to achieve an accurate leak diagnosis. However, a fuel tank made of a resin material, for example, sometimes deforms gradually as the internal pressure of the tank changes and eventually deforms by a large amount. The inventor found that in such a case, it is possible to accomplish a leak diagnosis because the deformation is gradual. However, if the leak diagnosis is stopped as described in Japanese Laid-Open Patent Publication No. 2003-83176 even when the deformation is gradual, then the frequency of completed diagnoses will decrease and there will be a possibility that a leaking state will go undiagnosed for a long period of time.

Therefore, an object of the present invention is to accomplish an accurate leak diagnosis of an evaporative emission control system when deformation of a fuel tank of the system progresses gradually.

One aspect of the present invention is to provide a leak diagnostic apparatus for an evaporative emission control system that purges fuel vapor from an inside of a fuel tank to an intake passage of an internal combustion engine. The leak diagnostic apparatus basically comprises a pressure detecting device and a leak determining device. The pressure detecting device is configured and arranged to detect a pressure inside the evaporative emission control system, which includes the fuel tank. The leak determining device sets a leak determination threshold value in accordance with a deformation amount of the fuel tank, and determines if a leak exists by comparing the pressure inside the evaporative emission control system while the evaporative emission control system is sealed to the leak determination threshold value.

These and other objects, features, aspects and advantages of the present invention will become apparent to those skilled in the art from the following detailed description, which, taken in conjunction with the annexed drawings, discloses preferred embodiments.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
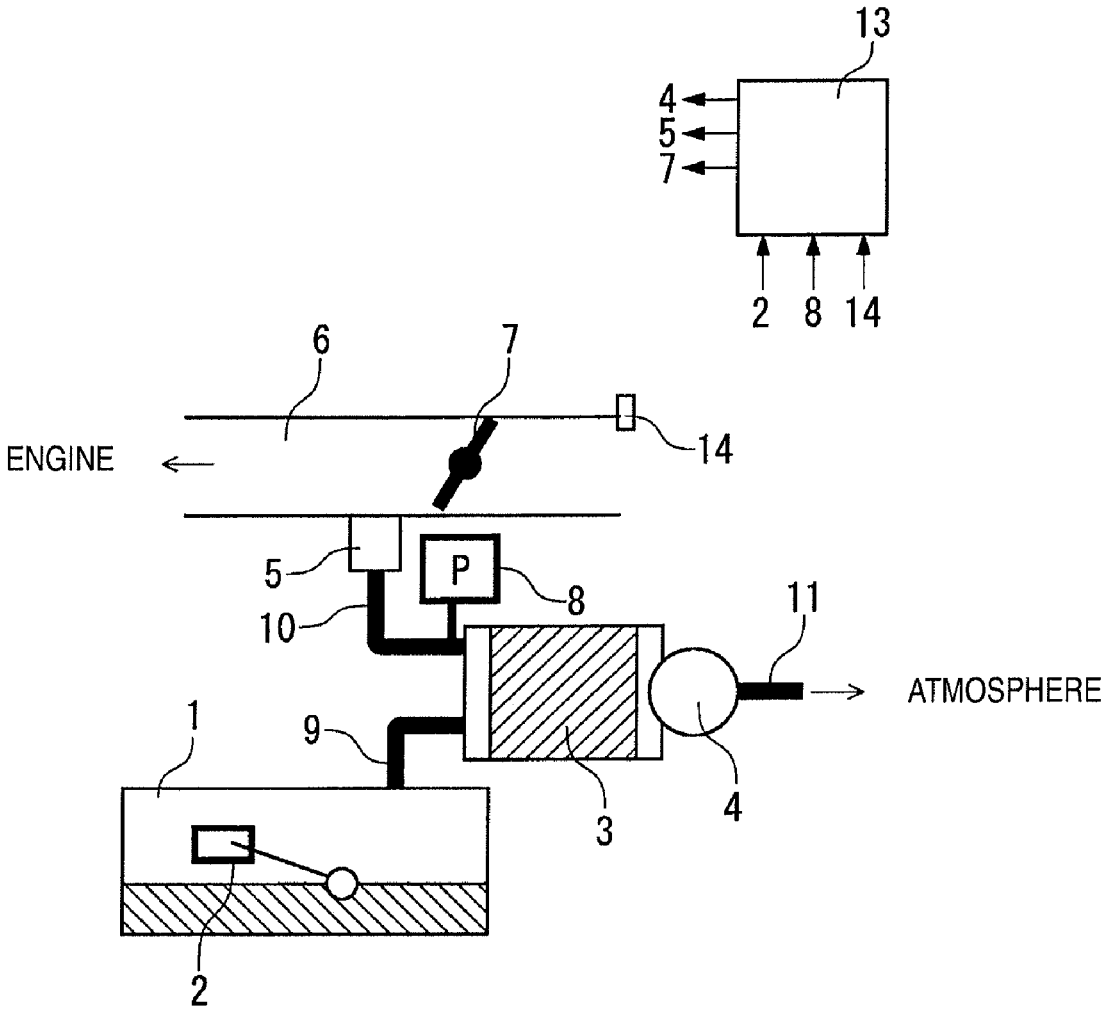
FIG. 1 is a schematic view of an evaporative emission control system with a leak diagnostic apparatus that employs a pump diagnostic method.

Referring initially to FIG. 1, an evaporative emission control system is schematically illustrated in accordance with a first embodiment. The evaporative emission control system basically includes a fuel tank 1, fuel level sensor 2, a canister 3, an air pump 4, a purge valve 5, an intake passage 6, a throttle valve 7, a pressure sensor 8, a vapor passage 9, a purge passage 10, a drain passage 11, a control unit 13, and an intake air temperature sensor 14. The fuel level sensor 2 is one example of a fuel level detecting device that is configured and arranged to detect a fuel level inside the fuel tank 1. The fuel tank 1 and the canister 3 are connected by the vapor passage 9 for communicating fuel vapor between the fuel tank 1 and the canister 3. The air pump 4 is arranged to pump air out of the canister 3 via the drain passage 11. The purge valve 5 regulates an amount of fuel vapor purged. The intake passage 6 provides intake air an engine. The throttle valve 7 is configured to regulate an intake air amount to the engine. The pressure sensor 8 is one example of a pressure detecting device. The purge passage 10 is arranged to communicate between the canister 3 and the intake passage 6 at a position downstream from the throttle valve 7. The drain passage 11 is arranged to communicate between an inside of the canister 3 and the outside atmosphere. The control unit 13 is one example of a leak determining device. The intake air temperature sensor 14 is one example of an ambient temperature detecting device.

The control unit 13 executes a leak diagnosis (described later) based on detection values obtained from the fuel level sensor 2 and the pressure sensor 8 while controlling the opening degrees of the purge valve 5 and the throttle valve 7 and the operating state (running or stopped) of the air pump 4. Thus, in this embodiment, the leak diagnostic apparatus includes, but not limited to, the fuel level sensor 2, the air pump 4, the purge valve 5, the throttle valve 7, the pressure sensor 8 and the control unit 13. With the leak diagnostic apparatus, a leak is determined to exist or not exist based on a leak determination threshold value set in accordance with a deformation of the fuel tank 1. As a result, an accurate leak diagnosis can be accomplished even when the fuel tank 1 changes shape.

The air pump 4 is a vacuum pump provided in the drain passage 11 and serves to reduce the pressure inside the evaporative emission control system by pumping air out of the evaporative emission control system through the drain passage 11.

The purge valve 5 remains closed except during a purge operation that will be described below. The inside of the canister 3 communicates with the outside atmosphere through the air pump 4 and the drain passage 11.

The control unit 13 preferably includes a microcomputer with a fuel vapor purging control program that controls purging of the fuel vapor and a leak diagnosis control program that controls the leak diagnosis as discussed below. The control unit 13 can also include other conventional components such as an input interface circuit, an output interface circuit, and storage devices such as a ROM (Read Only Memory) device and a RAM (Random Access Memory) device. The microcomputer of the control unit 13 is at least programmed to control the air pump 4, the purge valve 5 and the throttle valve 7 for carrying out the purging of the fuel vapor and the leak diagnosis explained below. The microcomputer of the control unit 13 is also at least programmed to receive detection results or values from fuel level sensor 2, the pressure sensor 8 and the intake air temperature sensor 14 for carrying out the leak diagnosis explained below. It will be apparent to those skilled in the art from this disclosure that the precise structure and algorithms for the control unit 13 can be any combination of hardware and software that will carry out the functions described herein.

A method of purging fuel vapor will now be explained.

Fuel vapor generated by the evaporation of fuel inside the fuel tank 1 flows into the canister 3 through the vapor passage 9 and is adsorbed onto an adsorbing material made of activated carbon or the like housed inside the canister 3. When the amount of adsorbed fuel vapor reaches a prescribed amount, the control unit 13 opens the purge valve 5. Since the pressure inside the intake passage 6 is below atmospheric pressure, when the purge valve 5 is opened, the pressure inside the purge passage 10 falls below atmospheric pressure and air flows into the canister 3 through the drain passage 11. This flow of air causes the fuel vapor adsorbed to the adsorbing material to separate from the adsorbing material and be purged to the intake passage 6 through the purge passage 10.

A leak diagnosis of the evaporative emission control system described above executed by the control unit 13 will now be explained.

A leak diagnosis executed according to this first embodiment is basically the same diagnostic method as what is generally called a pump diagnosis. In a pump diagnosis, after the engine is stopped, the purge valve 5 is closed to isolate the evaporative emission control system, which basically comprises the fuel tank 1, the vapor passage 9, the canister 3, and the purge passage 10. The air pump 4 is then operated so as to discharge air from inside the evaporative emission control system. If the pressure inside the system decreases to a pressure equal to or below a leak determination threshold value, then it is determined that a leak does not exist. If the pressure does not decrease to the prescribed leak determination threshold value, then it is determined that a leak exists. However, the method of setting the prescribed leak determination threshold value is different from other pump diagnostic methods.

Figure 2:
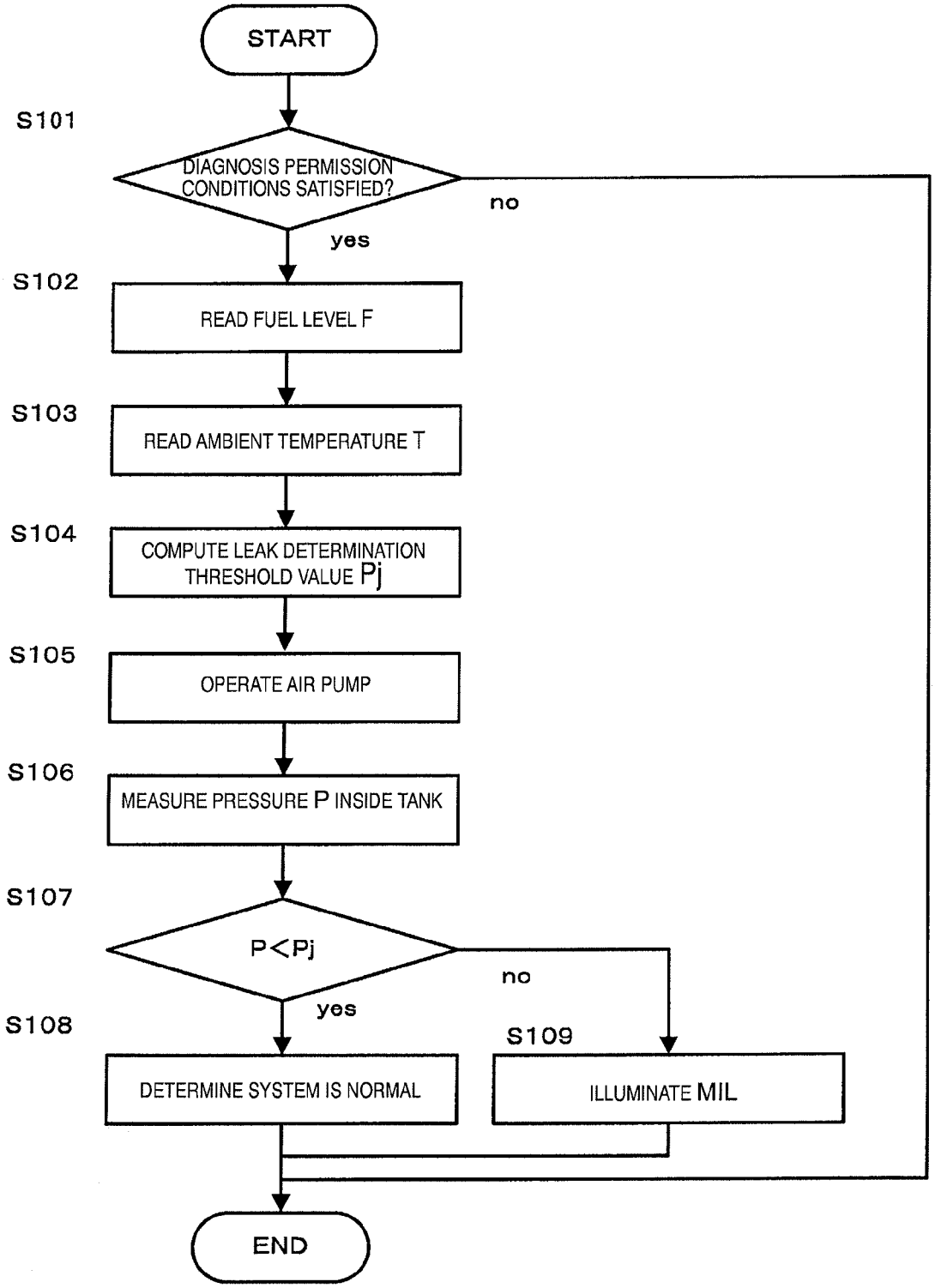
FIG. 2 is a flowchart of a leak diagnosis control in accordance with a first embodiment.

FIG. 2 is a flowchart of a leak diagnosis according to this first embodiment.

In step S101, the control unit 13 determines if conditions permitting execution of a diagnosis are satisfied. The diagnosis permission conditions are the same as the diagnosis conditions for a leak diagnosis using a typical pump method. For example, the diagnosis is permitted when three to five hours have elapsed since the engine was stopped and the outside temperature and pressure are within a prescribed range. The reason for waiting three to five hours after the engine is stopped is to allow the temperature inside the fuel tank 1 to stabilize. The temperature inside the fuel tank 1 temporarily rises after the engine is stopped because the air movement that cooled the fuel tank 1 while the vehicle was moving no longer exists and because the fuel tank 1 is warmed by heat from an exhaust passage arranged in the vicinity of the fuel tank 1.

The requirement that "the outside temperature and pressure are within a prescribed range" refers to typical ambient air conditions under which the vehicle is anticipated to be driven. This requirement prevents a diagnosis from being executed at very high elevations or under very cold conditions in which it is difficult to achieve an accurate determination.

If the diagnosis permission conditions are satisfied, then the control unit 13 proceeds to step S102. Otherwise, the control unit 13 ends the control loop.

In step S102, the control unit 13 reads a detection value of the fuel level sensor 2, i.e., the detected fuel level F inside the fuel tank 1.

In step S103, the control unit 13 reads an ambient temperature T of the evaporative emission control system. A detection value of the intake air temperature sensor 14 is used as the detected ambient temperature T.

In step S104, the control unit 13 computes a leak determination threshold value Pj based on the detected fuel level F and the detected ambient temperature T. The leak determination threshold value Pj is a pressure value (negative pressure value) that will be reached when the air pump 4 is driven if a leak does not exists in the evaporative emission control system.

Figure 3:
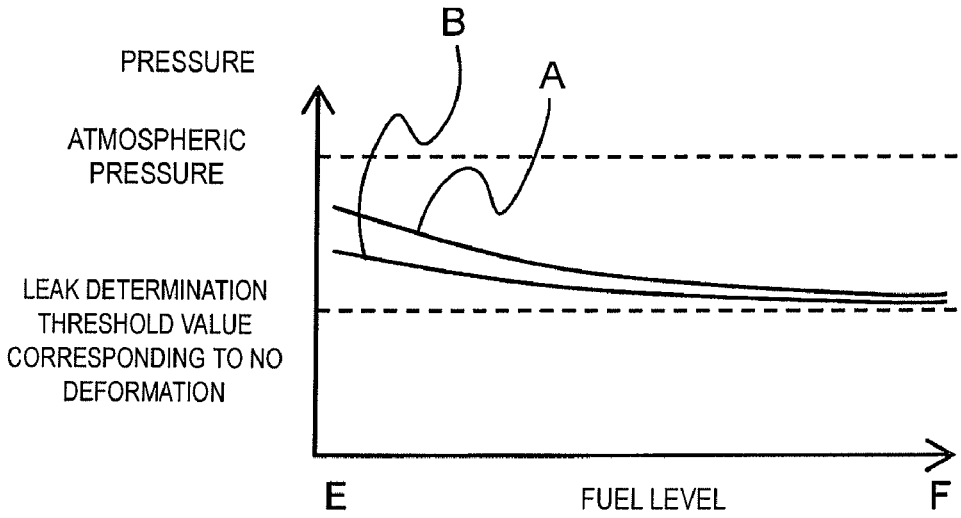
FIG. 3 is a leak determination threshold value map in accordance with the first embodiment.

More specifically, the computation is executed using the map shown in FIG. 3. FIG. 3 is a map having pressure indicated on a vertical axis and fuel level indicated on a horizontal axis. In FIG. 3, the lower broken line indicates a leak determination threshold value (reference leak determination threshold value) obtained when there is no deformation of the fuel tank 1. The solid curves A and B are leak determination threshold value curves indicating leak determination threshold values that have been revised with respect to a case in which there is no deformation of the fuel tank 1 based on the detected fuel level F and the detected ambient temperature T. The curve A corresponds to a high ambient temperature and the curve B corresponds to a normal ambient temperature.

When the fuel level is low, the leak determination threshold value Pj corresponding to a normal ambient temperature is higher than the leak determination threshold value Pj corresponding to a case in which there is no deformation of the fuel tank 1. Furthermore, the leak determination threshold value Pj corresponding to a high ambient temperature is higher than the leak determination threshold value Pj corresponding to a normal ambient temperature. As the ambient temperature T increases, the fuel tank 1 deforms more readily (this trend is particularly pronounced when the fuel tank 1 is made of resin) and, consequently, a larger amount of deformation occurs when the air pump 4 is driven so as to lower the pressure inside the fuel tank 1. The curves A and B are contrived to reflect this characteristic. In other words, the more the volume of the fuel tank 1 decreases due to deformation when the air pump 4 is driven, the less readily the pressure inside the evaporative emission control system will decrease. Consequently, the larger the amount of deformation of the fuel tank 1 is, the more likely it will be that an misdiagnosis will occur if the leak determination threshold value Pj is not set closer to atmospheric pressure.

As the fuel level F increases, both the curve corresponding to a high ambient temperature and the curve corresponding to a normal ambient temperature approach the leak determination threshold value corresponding to a case in which there is no deformation of the fuel tank 1. The curves are designed in this manner because it has been observed experimentally that as the fuel level F increases, i.e., as the volume of air inside the fuel tank 1 decreases, the ambient temperature makes less of a difference in the amount by which the pressure inside the evaporative emission control system decreases because the amount of deformation of the fuel tank 1 decreases.

The leak determination threshold value Pj (reference leak determination threshold value) corresponding to no deformation of the fuel tank 1 varies depending on the capacity of the air pump 4, i.e., on the vacuum pressure (negative pressure) pulled in the evaporative emission control system. For example, the closer the vacuum pressure pulled is to the atmospheric pressure, the closer the leak determination threshold value Pj will be to the atmospheric pressure. Therefore, a leak determination threshold value Pj tailored to the vacuum pressure imposed is found in advance experimentally based on the capacity of the air pump 4 used and the volume of the evaporative emission control system.

The same applies to the leak determination threshold value curve. Moreover, since the ease of deformation of the fuel tank 1 differs depending on the material and shape of the fuel tank 1, a leak determination curve tailored to the fuel tank 1 used is prepared using experimental data or the like.

Although only two leak determination threshold value curves, one corresponding to a normal temperature and one corresponding to a high temperature, are presented in this embodiment, in actual practice separate leak determination threshold value curves are prepared for each of a larger number of ambient temperatures separated by smaller intervals and the leak determination threshold value curve is selected according to the detected ambient temperature T.

In step S105, the control unit 13 operates the air pump 4 and lowers the pressure inside the evaporative emission control system.

In step S106, the control unit 13 measures a pressure P inside the fuel tank 1 based on a detection value of the pressure sensor 8.

In step S107, the control unit 13 compares the measured pressure P and the computed leak determination threshold value Pj. If the pressure P is smaller (i.e., if the degree of vacuum is large), then the control unit 13 proceeds to step S108 and determines that the system is normal. If the leak determination threshold value Pj is the smaller of the two values, then the control unit 13 proceeds to step S109 and alerts a driver that a leak exists by, for example, illuminating a MIL (malfunction indication lamp). The control unit 13 then ends the control loop.

As described above, the leak diagnostic apparatus of this embodiment computes the leak determination threshold value Pj in accordance with the detected fuel level F and the detected ambient temperature T. Thus, the computation is equivalent to estimating a deformation amount of the fuel tank 1 based on the detected fuel level F and the detected ambient temperature T and computing the leak determination threshold value Pj based on the estimated deformation amount. The leak determination threshold value Pj is then used to determine if a leak exists. This diagnostic method is particularly effective when the fuel tank 1 changes shape greatly depending on temperature, such as when the fuel tank 1 is made of a resin material.

Effects achievable with this embodiment will now be explained.

This leak diagnostic apparatus is for an evaporative emission control system that purges fuel vapor from the inside of the fuel tank 1 to the intake passage 6. The leak diagnostic apparatus has the pressure sensor 8 configured and arranged to detect a pressure inside the evaporative emission control system (the fuel tank 1, the canister 3, the vapor passage 9, and the purge passage 10) and the leak determining device (control unit 13) that determines if a leak exists by comparing a pressure detected while the evaporative emission control system is sealed to the leak determination threshold value Pj that is set in accordance with a deformation amount of the fuel tank 1. Since the existence or absence of a leak is determined based on a leak determination threshold value that is set in accordance with a deformation amount of the fuel tank 1, a situation in which a leak is incorrectly determined to exist because of a change in the shape of the fuel tank 1 can be prevented. More specifically, a situation in which the detected pressure does not decrease sufficiently during a diagnosis because of a change in the shape of the fuel tank 1 (and not because of a leak) can be avoided. Additionally, since the leak diagnosis is conducted using the leak determination threshold value Pj set based on a deformation amount, a leak diagnosis can be accomplished under a variety of conditions and a decline in the frequency of leak diagnoses can be prevented.

The leak determination threshold value PJ is set by revising the leak determination threshold value (reference leak determination threshold value) corresponding to a case in which there is no deformation of the fuel tank 1 based on the detected fuel level and/or the detected ambient temperature. That is, the leak determination threshold value Pj is set based on a fuel level that correlates to a deformation (shape change) of the fuel tank. As a result, the leak determination threshold value Pj that corresponds to the deformation of the fuel tank 1 can be set.

The apparatus sets the leak determination threshold value (reference leak determination threshold value) corresponding to a case in which there is no deformation of the fuel tank 1 and the revision amount (based on the detected fuel level F and/or the detected ambient temperature T) to be applied to that leak determination threshold value according to the vacuum pressure that will be pulled inside the evaporative emission control system. As a result, an accurate leak diagnosis can be accomplished regardless of the vacuum pressure pulled.

A second embodiment will now be explained with reference to FIGS. 4 and 5. The evaporative emission control system of FIG. 1 to which this second embodiment is applied is the same as for the first embodiment and, thus, an explanation thereof will be omitted.

Figure 4:
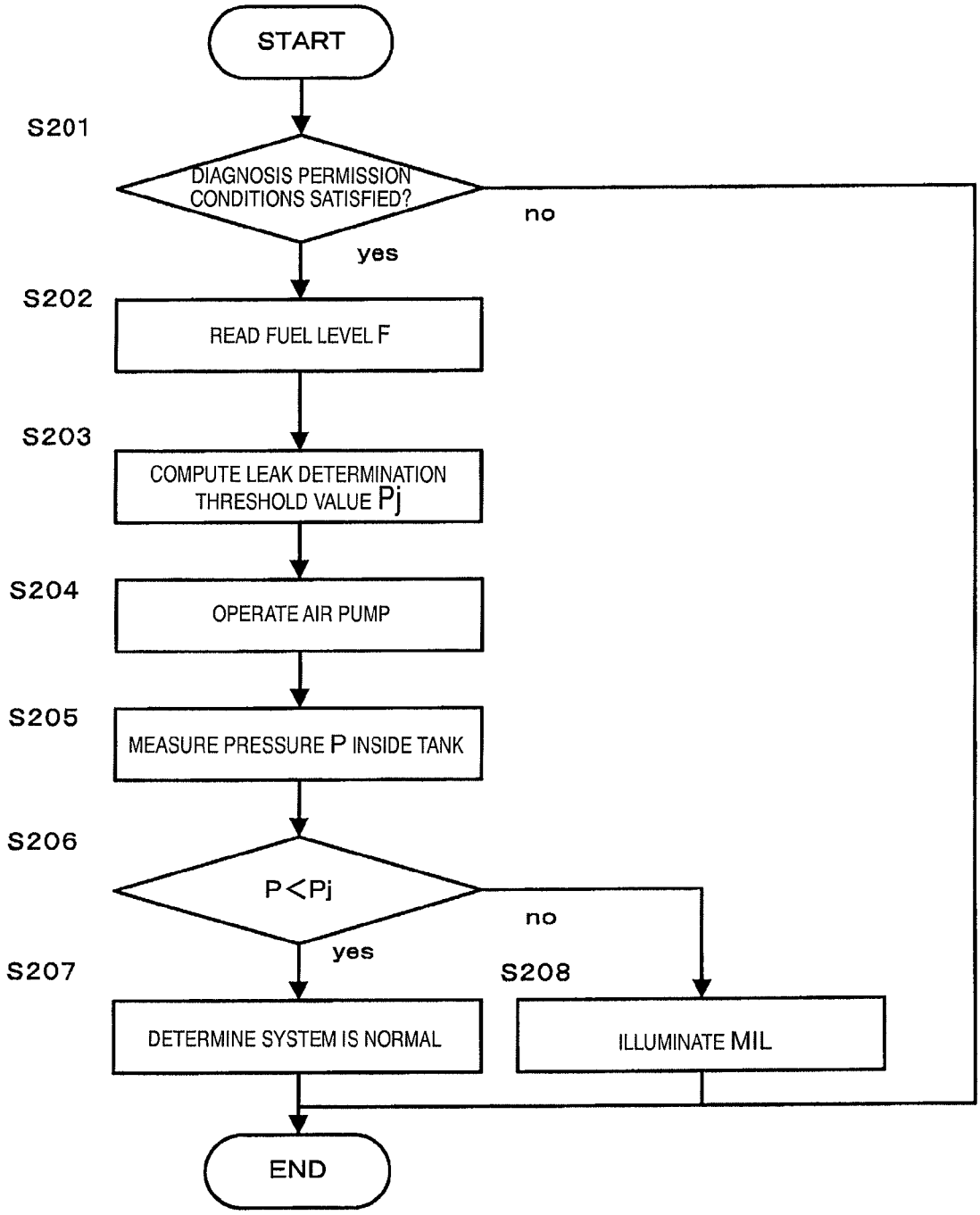
FIG. 4 is a flowchart of a leak diagnosis control in accordance with a second embodiment.

FIG. 4 is a flowchart of a leak diagnosis according to this second embodiment. Steps S201 and S202 are the same as steps S101 and S102 of FIG. 2, and steps S203 to S208 are the same as steps S104 to S109 of FIG. 2. Thus, this embodiment differs from the first embodiment in that it does not read an ambient temperature T and computes the leak determination threshold value Pj based solely on the fuel level F.

Figure 5:
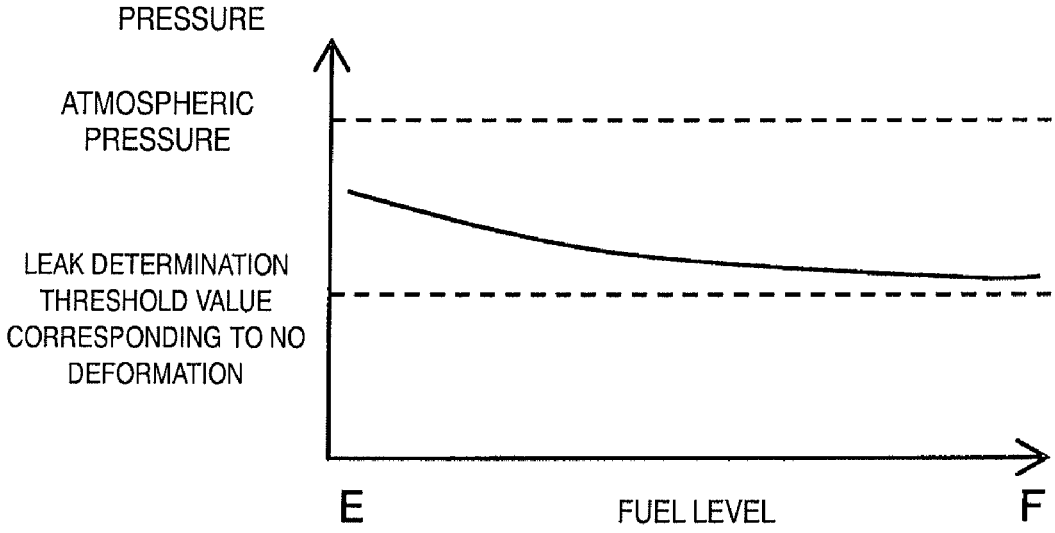
FIG. 5 is a leak determination threshold value map in accordance with the second embodiment.

FIG. 5 is a map for computing the leak determination threshold value Pj. Pressure is indicated on a vertical axis and fuel level is indicated on a horizontal axis. The broken line indicates a leak determination threshold value (reference leak determination threshold value) corresponding to a case in which there is no deformation of the fuel tank 1. The solid curve is a leak determination threshold value curve plotted versus the fuel level F. As shown in FIG. 5, the leak determination threshold value Pj is closer to the atmospheric pressure when the fuel level F is low and closer to the leak determination threshold value corresponding to a case in which there is no deformation of the fuel tank 1 when the fuel level F is high.

In this way, incorrect diagnoses resulting from deformation of the fuel tank 1 can be prevented and a sufficient frequency of diagnosis can be ensured even when the leak determination threshold value Pj is computed based solely on the fuel level F. In particular, this method can provide a sufficient frequency of leak diagnoses when the fuel tank 1 does not change shape very much in response to temperature changes, such in the case of a fuel tank made of metal.

In the preceding explanations, the embodiments are explained in terms of its application to a pump method of leak diagnosis. However, the leak diagnostic apparatus can also be applied to an engine vacuum method or an EONV (engine off natural vacuum) method that does not use an air pump 4.

Figure 6:
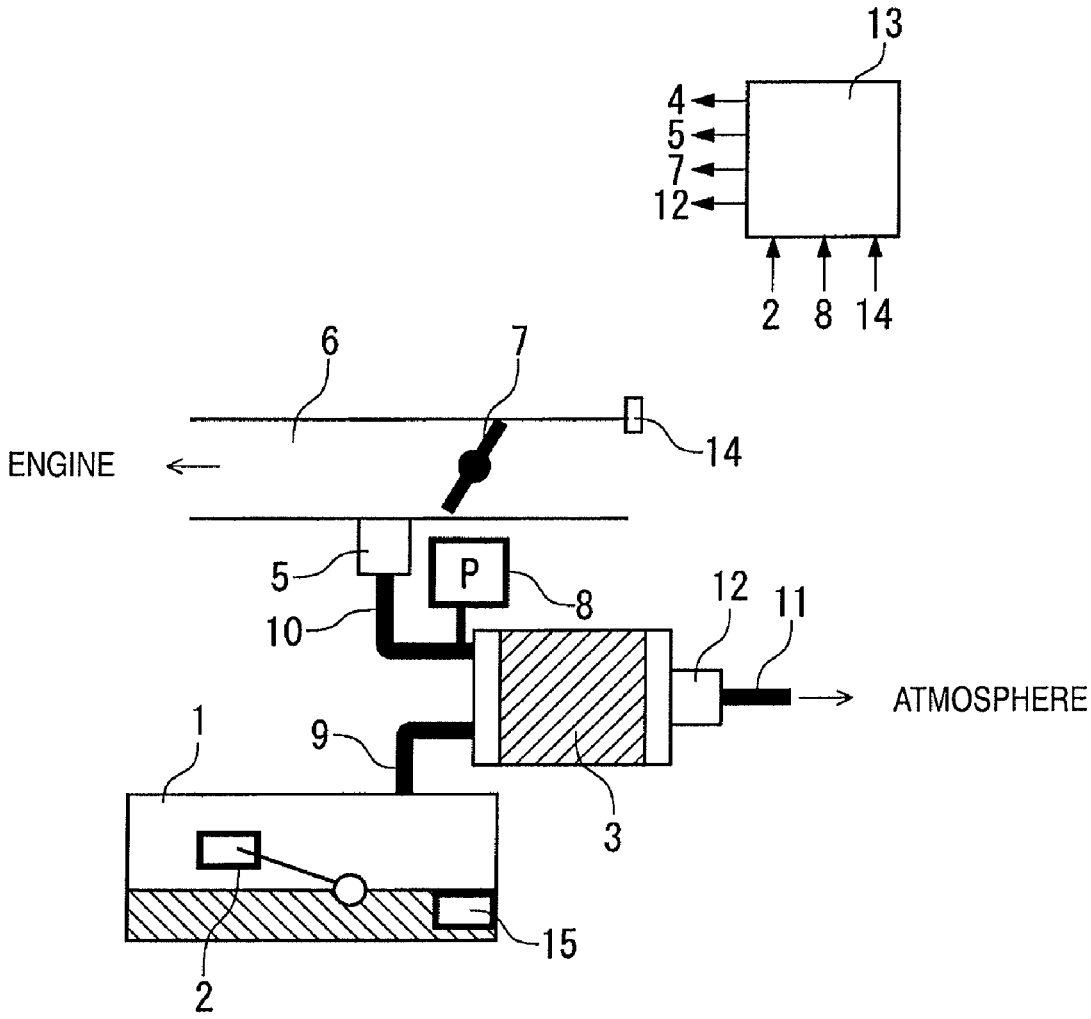
FIG. 6 is a schematic view of an evaporative emission system with a leak diagnostic apparatus that employs an engine vacuum diagnostic method or an EONV diagnostic method.

FIG. 6 is a schematic view of an evaporative emission control system in which an engine vacuum method or EONV method of leak diagnosis is employed. The system is basically the same as in the previously explained embodiments except that a drain cut valve 12 is arranged in the drain passage 11 instead of an air pump 4. Since the air pump 4 is not used, the drain cut valve 12 is necessary in order to seal a pressure inside the evaporative emission control system.

With the engine vacuum method, a leak diagnosis is executed while the vehicle is traveling by closing the drain cut valve 12 and opening the purge valve 5 such that the vacuum pressure in the intake passage 6 creates or pulls a vacuum inside the evaporative emission control system. After creating or pulling a vacuum, the purge valve 5 is closed such that the evaporative emission control system is sealed closed. The apparatus determines if a leak exists based on a change in the pressure inside the evaporative emission control system after the purge valve 5 is closed. More specifically, since the evaporative emission control system will hold the vacuum pressure if it does not have a leak, the apparatus determines that a leak exists if the pressure inside the evaporative emission control system rises beyond a prescribed leak determination threshold value.

In the case of an EONV method, the drain cut valve 12 is closed and the evaporative emission control system is sealed after the engine is stopped. The apparatus then determines if a leak exists based on a change in the pressure inside the evaporative emission control system. As explained previously, the temperature inside the fuel tank temporarily rises after the engine is stopped due to the effect of heat from an exhaust passage and the absence of air cooling that occurred while the vehicle was moving. The temperature inside the fuel tank then decreases as the temperature of the exhaust passage decreases. Since the pressure inside the evaporative emission control system can be expected to change as the temperature changes if a leak does not exist, the apparatus determines that a leak exists if the pressure change is smaller than a prescribed leak determination threshold value even though the fuel temperature is changing. The fuel temperature is detected by a fuel temperature sensor 15.

In the vacuum method or the EONV method, an accurate diagnosis can be accomplished even when the shape of the fuel tank 1 changes by varying the leak determination threshold value used to determine if a leak exists based on the fuel level F and the ambient temperature T.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. The term "detect" as used herein to describe an operation or function carried out by a component, a section, a device or the like includes a component, a section, a device or the like that does not require physical detection, but rather includes determining, measuring, modeling, predicting or computing or the like to carry out the operation or function. The term "configured" as used herein to describe a component, section or part of a device includes hardware and/or software that is constructed and/or programmed to carry out the desired function. The terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A leak diagnostic method for an evaporative emission control system that purges fuel vapor from an inside of a fuel tank to an intake passage of an internal combustion engine, comprising:

detecting a pressure inside the evaporative emission control system, which includes the fuel tank;

detecting a fuel level in the fuel tank;

calculating a leak determination threshold value based on the detected fuel level to account for a deformation amount of the fuel tank; and determining is a leak exists by comparing the pressure inside the evaporative emission control system while the evaporative emission control system is sealed to the leak determination threshold value.

2. The leak diagnostic method according to claim 1, wherein during the calculation of the leak determination threshold value, the relationship between the fuel level and the leak determination threshold value is such that as the detected fuel level becomes lower, the leak determination threshold value becomes closer to atmospheric pressure.

3. The leak diagnostic method according to claim 1, further comprising:

calculating a reference leak determination threshold value corresponding to a case in which there is no deformation of the fuel tank while the evaporative emission control system is sealed after having been pulled to a vacuum pressure, and the calculation of the leak determination threshold value being performed by revising the reference leak determination threshold value by a revision amount based on the detected fuel level.

4. A leak diagnostic method for an evaporative emission control system that purges fuel vapor from an inside of a fuel tank to an intake passage of an internal combustion engine, further comprising:

detecting a pressure inside the evaporative emission control system, which includes the fuel tank;

detecting a fuel level in the fuel tank;

detecting an ambient temperature of the evaporative emission control system;

calculating a leak determination threshold value based on the detected fuel level and the detected ambient temperature to account for a deformation amount of the fuel tank; and determining if a leak exists by comparing the pressure inside the evaporative emission control system while the evaporative emission control system is sealed to the leak determination threshold value.

5. The leak diagnostic method according to claim 4, wherein during the calculation of the leak determination threshold value, the relationship between the detected ambient temperature and the leak determination threshold value is such that as the detected ambient temperature becomes higher, the leak determination threshold value becomes closer to atmospheric pressure.

* * * * *